United States Patent [19]

Watarai et al.

[11] Patent Number: 5,066,978

[45] Date of Patent: Nov. 19, 1991

[54] IMAGE FORMING APPARATUS HAVING AN EXCHANGEABLE UNIT EXCHANGE TIMING INDICATING DEVICE

[75] Inventors: Shinichi Watarai, Yokohama; Megumi Yasuda, Kawasaki; Yoji Houki, Tokyo; Yukio Nishio, Tama, all of Japan

[73] Assignee: Fujitsu Limited, Kawasaki, Japan

[21] Appl. No.: 359,012

[22] Filed: May 31, 1989

[30] Foreign Application Priority Data

Jun. 2, 1988 [JP] Japan ..... 63-136115

[51] Int. Cl.[5] ..... G03G 21/00

[52] U.S. Cl. ..... 355/206; 355/200

[58] Field of Search ..... 355/200, 206, 207, 208, 355/210, 245

[56] References Cited

U.S. PATENT DOCUMENTS

| | | | |
|---|---|---|---|
| 4,496,237 | 1/1985 | Schron | 355/209 |
| 4,551,000 | 11/1985 | Kanemitsu et al. | 355/210 |
| 4,687,320 | 8/1987 | Nakanishi et al. | 355/206 |
| 4,751,484 | 6/1988 | Matsumoto et al. | 355/207 |
| 4,851,875 | 7/1989 | Tanimoto | 355/245 |

FOREIGN PATENT DOCUMENTS

| | | |
|---|---|---|
| 227242 | 7/1987 | European Pat. Off. . |
| 61-100766 | 5/1986 | Japan . |

*Primary Examiner*—Fred L. Braun

*Attorney, Agent, or Firm*—Armstrong, Nikaido, Marmelstein, Kubovcik & Murray

[57] ABSTRACT

The image forming device of this invention is related to a device such as a duplicator, a printer, a facsimile or the like in which a printing operation is carried out by utilizing an electrophotographic recording system and an electrostatic recording system, wherein the device includes a plurality of consumable working parts including at least a developing unit, a drum unit, a fixing unit, and a transfer unit, and the device further includes a unit for integrating the working time of each of the working parts, a memory for storing the integrated working time of each working part, a lifetime setting unit in which a predetermined lifetime of each working part is set, and a generator for generating an exchange requirement signal for at least one of the working parts when the integrated working time of the working part reaches the lifetime of the part set in the lifetime setting unit, whereby an image forming device having a system in which these consumable working parts can be exchanged at correct intervals, regardless of the conditions of use, is provided.

10 Claims, 11 Drawing Sheets

| Fig. 5A | Fig. 5B |
|---|---|

IMAGE FORMING APPARATUS HAVING AN EXCHANGEABLE UNIT EXCHANGE TIMING INDICATING DEVICE

BACKGROUND OF THE INVENTION

1. Field of the Invention

This invention relates to an image forming device such as a duplicator, a printer, a facsimile or the like in which a printing operation is carried out utilizing an electrophotographic recording system and an electrostatic recording system.

2. Description of the Related Art

In this kind of image forming device, a plurality of devices such as a photosensitive member, a developing unit, a transfer unit, a fixing unit or the like are provided as working parts, but obviously the life-time of these working parts is generally shorter than that of durable parts such as a motor or the like. Accordingly, these working parts having a relatively shorter lifetime are currently handled as consumable goods and are exchanged when their life-time is exhausted. To this end, in current maintenance procedures for a large-size image forming device, these consumable working parts are examined by an experienced operator at suitable intervals, and are exchanged at the discretion of the operator. In the maintenance procedure of a small-size image forming device, however, these consumable working parts are generally examined by the user, and therefore, such a small-sized image forming device is usually provided with a counter and a memory, the number of sheets printed by the image forming device is counted and integrated by this counter, and the integrated number of sheets printed in this image forming device is stored in the memory. In one type of these image forming devices, these consumable working parts are exchanged when a predetermined total number of printed sheets or number of sheets integrated by the mechanical counter as explained above is reached, or upon a lessening of the quality of the printed characters. Therefore, when the total number of sheets printed in the image forming device reaches the predetermined number previously set for a certain consumable working part of this device, the requirement for an exchange of that certain consumable working part will be generated and displayed to the user.

Usually, however, a simple proportional relationship between the lifetime of those consumable working parts and the number of printed sheets does not exist, and further, the lifetime of these consumable working parts is greatly affected by the conditions of the current usage of the image forming device, and thus it is difficult for the user to determine the correct intervals for an exchange of these consumable working parts.

For example, the photosensitive characteristic of a photosensitive member used in an image forming device utilizing an electrophotographic recording system will be deteriorated by a repeated incidence of a corona radiation from a precharging unit, a writing operation, an incidence of a corona radiation from a transfer unit and an incidence of a light from a lamp in a discharge unit, and further deteriorated by wear stemming from repeated contact with a developing substance, sheets to be printed, and a cleaner. This deterioration will occur not only in a period $T_p$ of a printing operation but also in a period $T_{PRE}$ of a process carried out prior to the printing operation (in which an initializing of the process, a charging, a writing, a sheet supply or the like is carried out.) and in a period $T_{aft}$ of a process carried out after the printing operation is completed (in which a discharge of the photosensitive member, a cleaning thereof a feeding of sheets out of the device or the like is carried out.).

The extent of such deterioration occurring during the printing operation, and caused mainly by the deterioration of, for example, the photosensitive member, will vary greatly between an image forming device in which the printing operation is repeatedly carried out every time one cut sheet is printed, as shown in FIG. 7(A), and an image forming device in which a continuous printing operation is carried out as shown in FIG. 7(B).

As a result, in the case shown in FIG. 7(A), often a consumable working part will be used even after the lifetime thereof is exhausted, and in the case shown in FIG. 7(B), a consumable working part must be exchanged before the lifetime thereof is exhausted.

SUMMARY OF THE INVENTION

This invention is intended to overcome the drawbacks of the conventional system, and therefore, an object of this invention is to provide an image forming device having a system in which the consumable working parts can be exchanged at a correct interval regardless of the condition thereof.

Therefore, according to the present invention, there is provided an image forming device comprising a plurality of processing devices i.e., consumable working parts including at least a developing unit, a drum unit, a fixing unit, and a transfer unit, the image forming device further comprising;

a means for integrating the working time of each of working part, a memory means for storing the integrated working time of each working part therein, a lifetime setting means by which a predetermined lifetime of each working part is set, a means for generating an exchange requirement signal for a working part when the integrated working time thereof reaches the lifetime of the part set by the lifetime setting means, and a display means for displaying at least one of the exchange requirement signals for each of the working parts.

According to this invention, the image forming device is further characterized in that the device comprises a prediction means for predicting the possibility of a generation of an exchange requirement signal, for at least one of the processing device i.e., the working parts to be exchanged after a predetermined number of sheets have been processed to form an image thereon, and a memory and display means for storing and displaying the preliminary exchange requirement signal generated by the prediction means even when the exchange requirement signal generating means does not generate an exchange requirement signal for the working part.

In this invention, the end of the lifetime of each consumable working part in the device is independently checked, and when the time at which a certain consumable working part should be exchanged is reached, this information is displayed on a suitable display means to inform the user of this exchange requirement.

Further according to this invention, even though the end of the lifetime of a consumable working part has not been reached, the information that the end of the lifetime of a consumable working part will be reached in the near future will be displayed together with or without the display of the exchange requirement information.

In this invention, an exchange requirement signal for a consumable processing device i.e., a consumable working part is generated by a process comprising the steps of, supplying power to the device to generate a pulse from a pulse generator, counting this pulse by the integrating working time means for a working part, to determine the integrated working time of the part, storing the counted number of pulses to the memory means for that part, comparing the counted number of pulses with a predetermined number of pulses corresponding to the lifetime of the working part and stored in the lifetime setting means, generating the exchange requirement signal for the working part when the counted number of pulses reaches the predetermined set number of pulses storing the exchange requirement signal in a memory, repeating the above steps for each of several other working parts, successively one by one, and displaying the exchange requirement signal at the display means when at least any one of a counted number of pulses of a working part reaches the predetermined set number.

DESCRIPTION OF THE PREFERRED EMBODIMENTS

The preferred embodiments of this invention will be explained in more detail with reference to the attached drawings.

As explained above, the image forming device of the present invention includes an image printing device used for a copying machine and a printer used for a computer, a facsimile, or the like. In this invention, the printing means is not restricted to a specific printing means, and any printing means, for example, an electrostatic recording system, an electrophotographic recording system, and a thermal transfer recording system or the like, can be used.

The sheet to be printed in this image forming device may be made of any material on which images can be printed, for example, a paper or a film.

Figure 1:
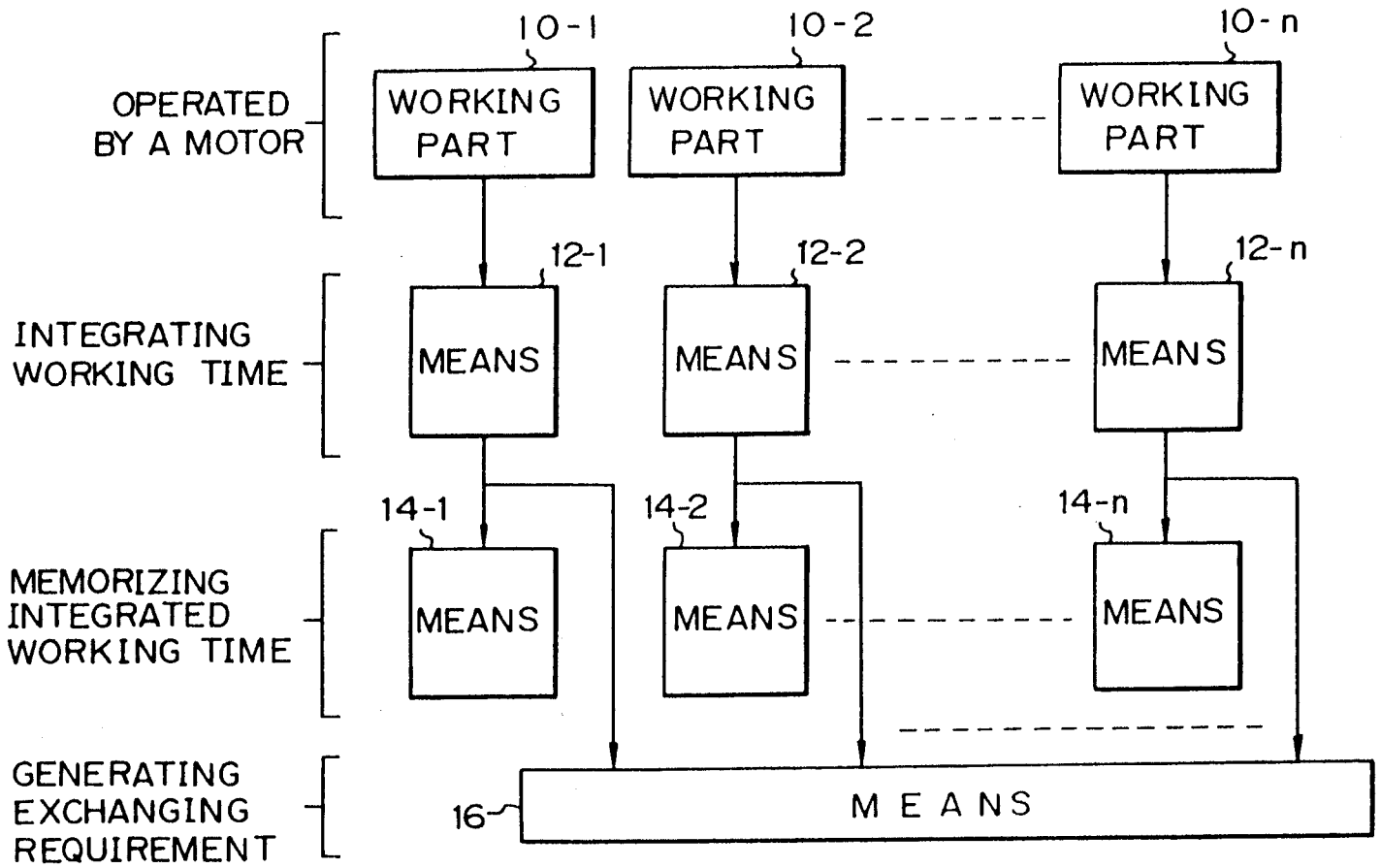
FIG. 1 is a block diagram explaining the principle of the present invention.

The principle of this invention is explained with reference to FIG. 1, wherein consumable working parts 10-1, 10-2, and **10-*n*, which may be driven by a motor or the like, are provided in the image forming device, and means 12-1, 12-2, and 12-*n* are provided for integrating the working time of each consumable working part 10-1, 10-2, and 10*n*, respectively; each of the working time integrating means 12-1, 12-2, and 12*n* being arranged in correspondence with and connected to each working part 10-1, 10-2, and 10-*n***.

The integrated working time of each consumable working part 10-1, 10-2, and **10*n* is stored in a storing means 14-1, 14-2 and 14-*n* connected to the working time integrating means 12-1, 12-2, and 12*n*, respectively, and when any one of the integrated working time of the consumable working parts 10-1, 10-2, and 10*n* reaches a predetermined set value, a signal notifying a requirement for an exchange of one of the consumable working parts 10-1, 10-2, and 10*n* due to an end of the lifetime thereof, is generated and displayed by the display means 16**. A preferred embodiment of the present invention will be explained hereunder with a reference to the attached drawings.

Figure 2:
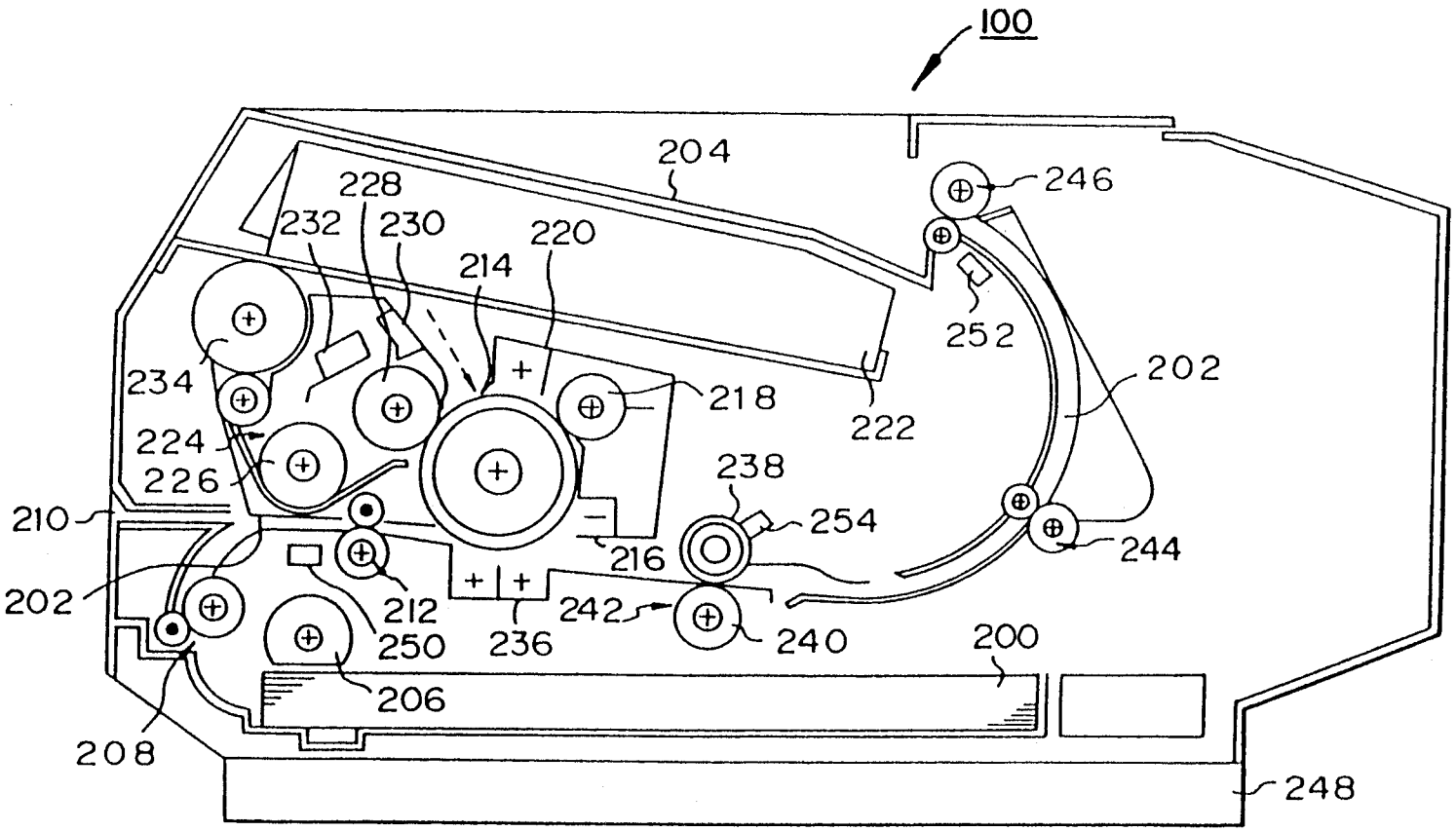
FIG. 2 is a cross sectional view showing the inner construction of one embodiment of the image forming device of this invention.

In FIG. 2, the cut sheets 200, for example, a paper or a film or the like, are stacked on the inner bottom portion of the LED (Light Emitting Diode) printer 100, and contained in a cassette or the like, and the cut sheets 200 are picked up by a pick-up roller 206, one by one from the top of the stack of sheets in the cassette, and fed into a cut sheet carrying passage 202 having curved portions to form an S-shaped configuration, and provided inside of the LED printer 100 for carrying the cut sheets to an outlet sheet tray 204, i.e., a stacker provided at an upper portion of the LED printer 100.

The cut sheets picked up by the pick-up roller 206 are carried into the sheet carrying passage 202 by a feed roller 208. Alternatively, the cut sheets 200 can be inserted into the sheet carrying passage 202 through a sheet inlet 210 provided on the side wall of the LED printer 100, as shown on the left hand side of FIG. 2.

In the sheet carrying passage 202, a roller 212 is provided downstream of the roller 208 and the cut sheet inlet 210, whereby cut sheets picked up from the cassette or inserted at the cut-sheet inlet 210 can be carried to the lower portion of a photosensitive drum 214 along the sheet carrying passage 202.

The photosensitive drum 214 is the main element of the printing means of this invention, and consists of a cylindrical member having a photosensitive film material coated on the outer surface thereof, and associated devices such as an image writing device, a developing device, a transfer device, a discharge device, and a precharging device, arranged in close contact to the surface thereof and encircling the drum 214.

The surface of the photosensitive drum 214 is discharged by the discharge device 216 after the toner is transferred, and thereafter, is cleaned by the cleaner 218 and again charged by the precharging device 220.

At this stage, the surface of the drum is given an electrical potential of, for example, −600V by the precharging device 220.

Further, after the precharging operation is carried out, an image is formed on the surface of the drum 214 in such a way that a light emitted from the LED array 400 provided in a drum writing unit 222 and arranged in a line parallel to the axial direction of the drum, is incident on the surface of the drum 214 to form the latent image thereon, and the latent image is developed in the developing device 224 to form a toner image.

The developing device 224 in this embodiment comprises a paddle roller 226, a developing roller 228, a blade 230, and a flow control plate 232, and the toner is supplied from a toner supply device 234.

The toner image thus developed on the photosensitive drum 214 is transferred to a surface of the cut sheet 200 by the transfer device 236. When the light emitted from the LED array 400 is incident on the surface of the photosensitive drum 214, the electric potential of the point of the surface thereof on which the LED light is incident is made 0V, i.e., to a natural characteristic of the photosensitive material coated on the surface of the drum 214.

On the other hand, the toner is generally charged at a minus voltage (V) of, for example, about −500V, and thus when the drum 214 is rotated and the point having the electric potential 0V is in contact with the developing device 224, the toner is attached to that point to form an image on the drum 214. Further, when the image formed on the surface of the drum 214 is transferred to the cut sheet 200 by transferring the toner image to the surface of the cut sheet 200, an electric potential of about ±5 kV as a transfer charge is applied to the surface of the cut sheet 200, to enable the transfer of the toner from the drum 214 to the surface of the cut sheet 200.

Then the cut sheet 200 to which the toner image has been transferred is carried to toner fixing device 242 consisted of a heat roller 238 including a halogen lamp 310 therein and a pressure roller 240.

After the transferred toner image is fixed on the cut sheet 200 at the toner fixing device 242, the cut-sheet 200 is carried to the outlet sheet tray 204 through feed rollers 244 and 246.

Namely, after the transfer operation is completed, the cut sheet 200 is subjected to a thermal treatment by the heating roller 238 at a temperature of, for example, 190° C., to fix the toner image on the cut sheet 200.

In this embodiment, a section 248 containing a controller 308 for controlling the operation of the devices in this printer is provided on the bottom surface of the LED printer 100, and further, detectors 250 and 252 for detecting the edges of the cut sheet 200 carried in the sheet carrying passage 202 is provided upstream of the roller 212 and roller 246, respectively.

Further, a sensor 254 for detecting the temperature of the heat roller 238 is provided on the heat roller 238 and the temperature of the heat roller 238 is controlled by a signal output from the sensor 254.

Figure 3:
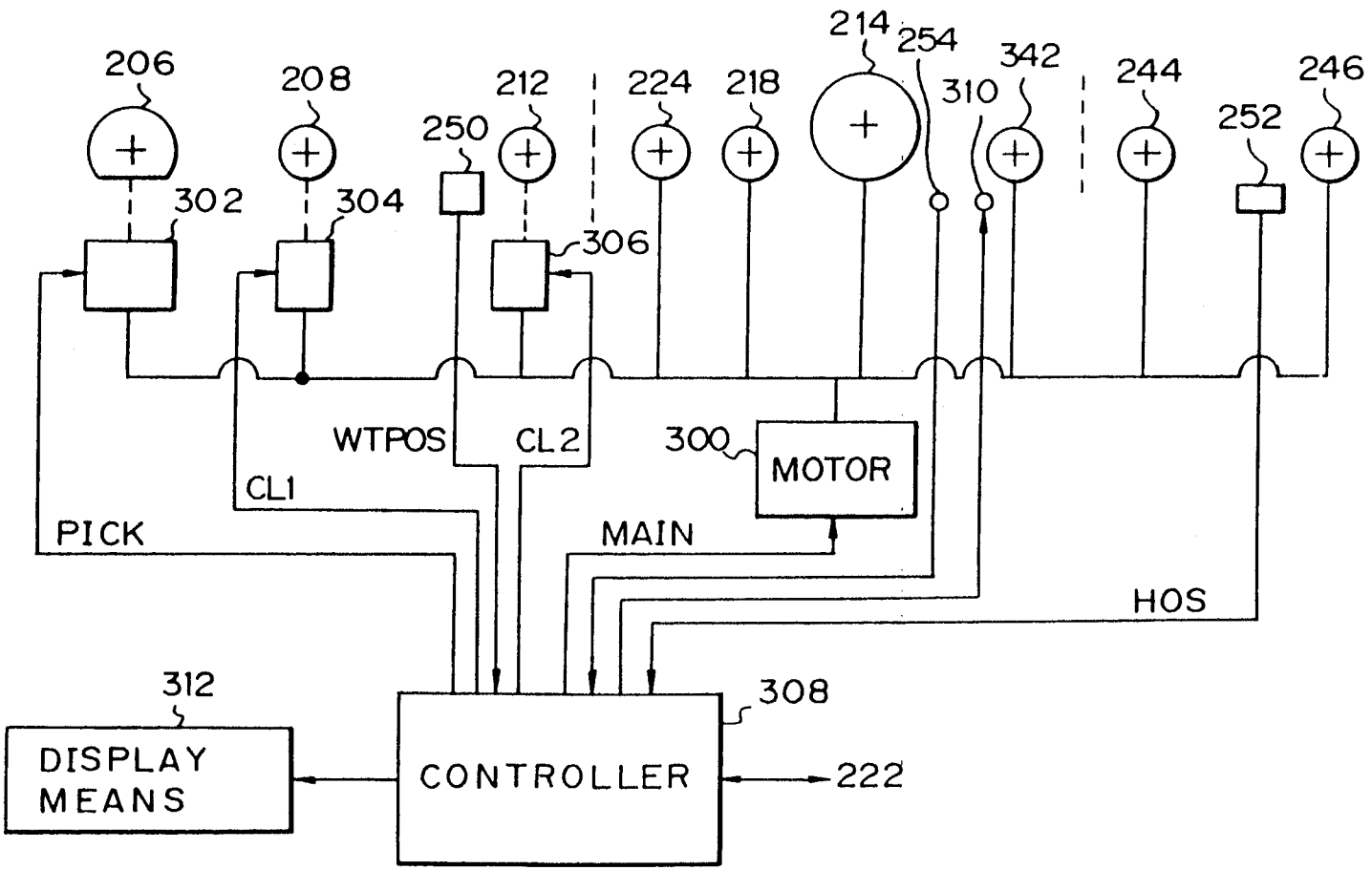
FIG. 3 is a diagram of the control system of the image forming device shown in FIG. 2.

In FIG. 3, the control system of the LED printer of this invention is explained, and as apparent from the FIG. 3, the drive forces required for the operation of the respective devices are given by a motor 300. Further, each roller 206, 208, and 212 is provided with a clutch 302, 304, and 306, respectively, and these rollers, clutches and the motor 300 are controlled by the controller 308 contained in the controller containing section 248. The current flowing to the halogen lamp 310 contained inside the heat roller 238 is also controlled by the controller 308.

Further, a display means 312 is provided and is controlled by the controller 308, and the exchange of consumable working parts such as a drum unit including the photosensitive drum 214, a developing unit 224, a transfer unit 236 and a fixing unit 242, or the like is carried out in accordance with the display at the display means 312.

In FIG. 3, each line extending from the motor to each device such as a rollers 206, 208, 212, 224, 218, 214, 242, 244, 246 respectively is indicating a driving force transmitting means such as a gear array, belt or the like for transmitting such force from the motor to each device in a simplified form.

In this invention, the exchange of the consumable working parts of the image forming device is carried out under the principle that the exchange requirement signal for each respective consumable working part is displayed as accurately as possible by taking into account the deterioration rate of each respective working part based on the conditions of use thereof, not by determining the exchange time thereof only in accordance with the integrated number of sheets printed, as in the conventional system. Namely, in this invention, the time factor is introduced into the determination of the exchange time for each respective working part by counting and integrating pulses from the time when the device is started by supplying electric power thereto, with or without adding a pertinent weight to the count due to the condition under which the part is used, instead of counting only the number of printed sheets. To realize the object of this invention, the control system for determining the time at which a consumable working part should be exchanged basically comprises the following steps: supplying power to the device to generate a pulse from a pulse generator; counting this pulse by the integrating working time means for a working part, to determine the integrated working time of the part; storing the counted number of pulses to the memory means for the part; comparing the counted number of pulses with a predetermined number corresponding to the lifetime of the working part stored in the lifetime setting means; generating an exchange requirement signal for the working part when the counted number of pulses reaches the predetermined set number; storing the exchange requirement signal in a memory; repeating the above steps for each of several other working parts successively one by one; and displaying the exchange requirement signal at the display means when the counted number of pulses of any one of the working parts reaches the predetermined set number.

The control system of the present invention will be explained in more detail by a specific embodiment thereof, with reference to FIGS. 4 and 5.

Figure 4:
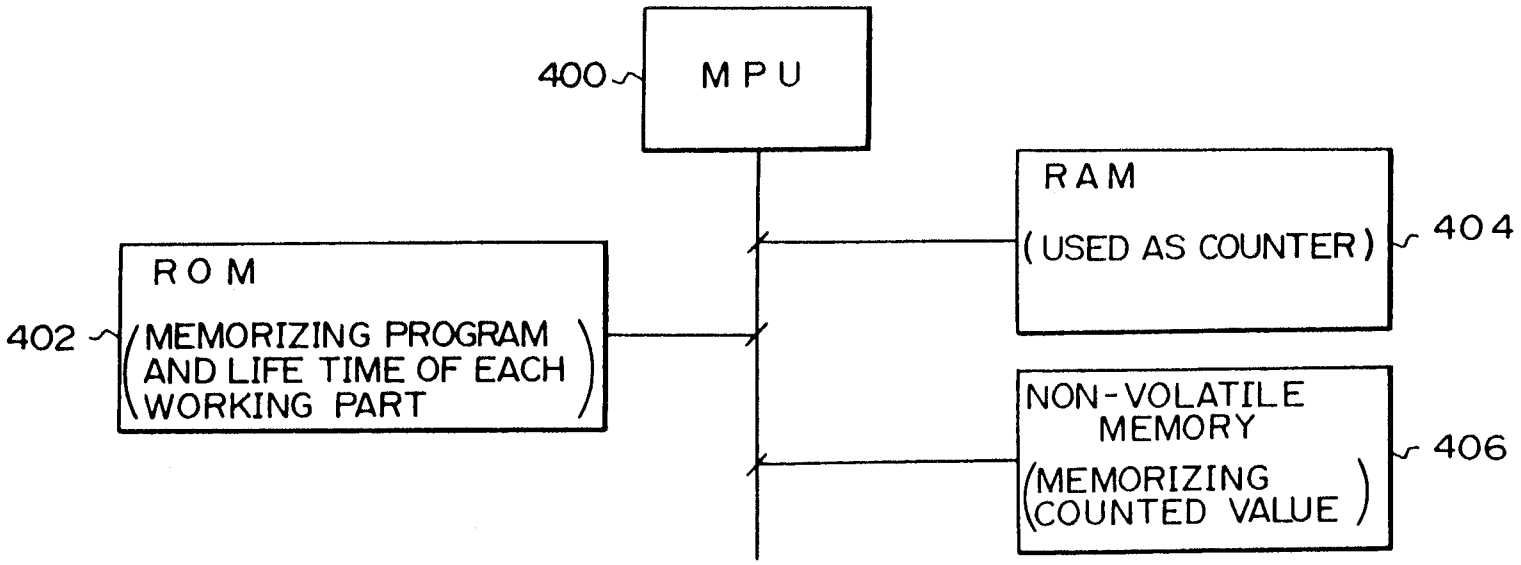
FIG. 4 is a block diagram explaining one embodiment of a controller used in the present invention.

FIG. 4 shows the basic construction of the controller 308 shown in FIG. 3, wherein control operations of this device are carried out by an MPU (Micro Processor Unit) 400. The control program therefor is stored in a ROM 402 and is used for processing the MPU 400.

A plurality of data corresponding to a lifetime of each consumable working part (lifetime value), including the time factor, are stored in the ROM 402, and the RAM 404 is used as a counter for counting the working time of each consumable working part.

The number counted by the RAM 404 and indicating the integrated working time of each working part is stored in a non-volatile memory 406, and thus the counted number of the integrated working time of each working part is always held in the memory, even when the electric power for the device is accidentally shut down.

Figures 5, 5A:
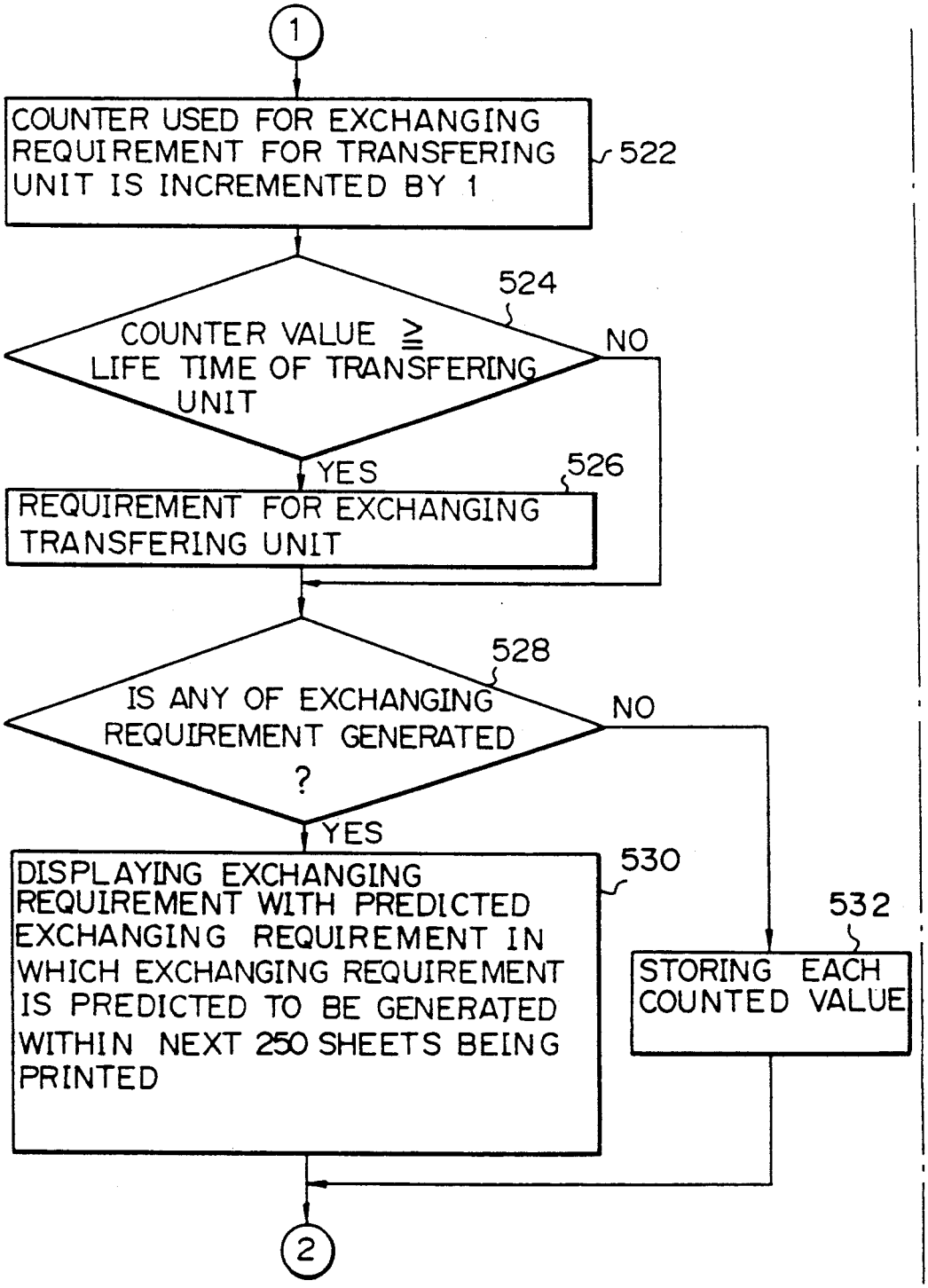
FIG. 5 includes FIGS. 5A and 5B which together depict a flow chart explaining the operation of one embodiment of the present invention.
Figure 5B:
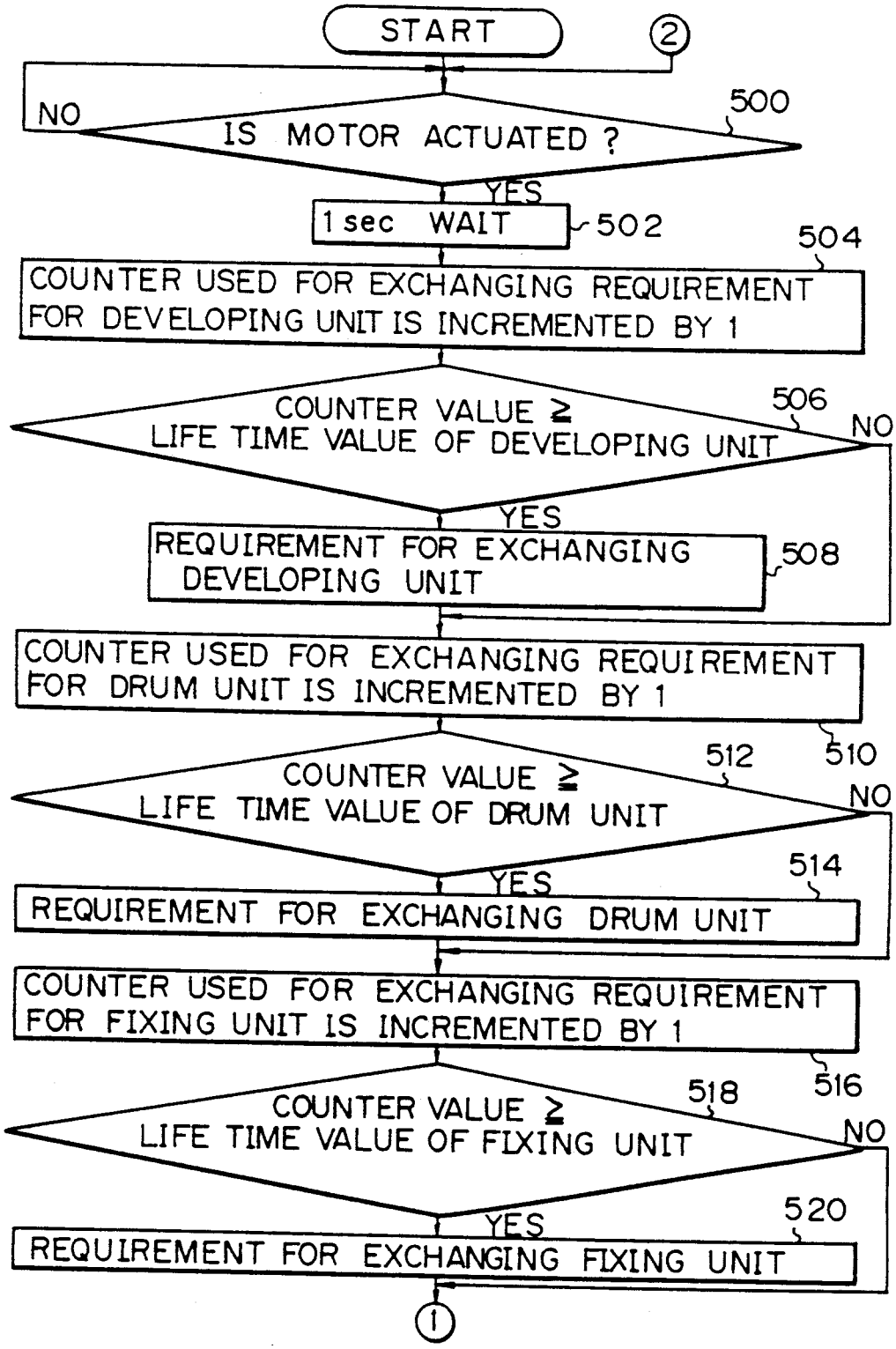
Figure 6:
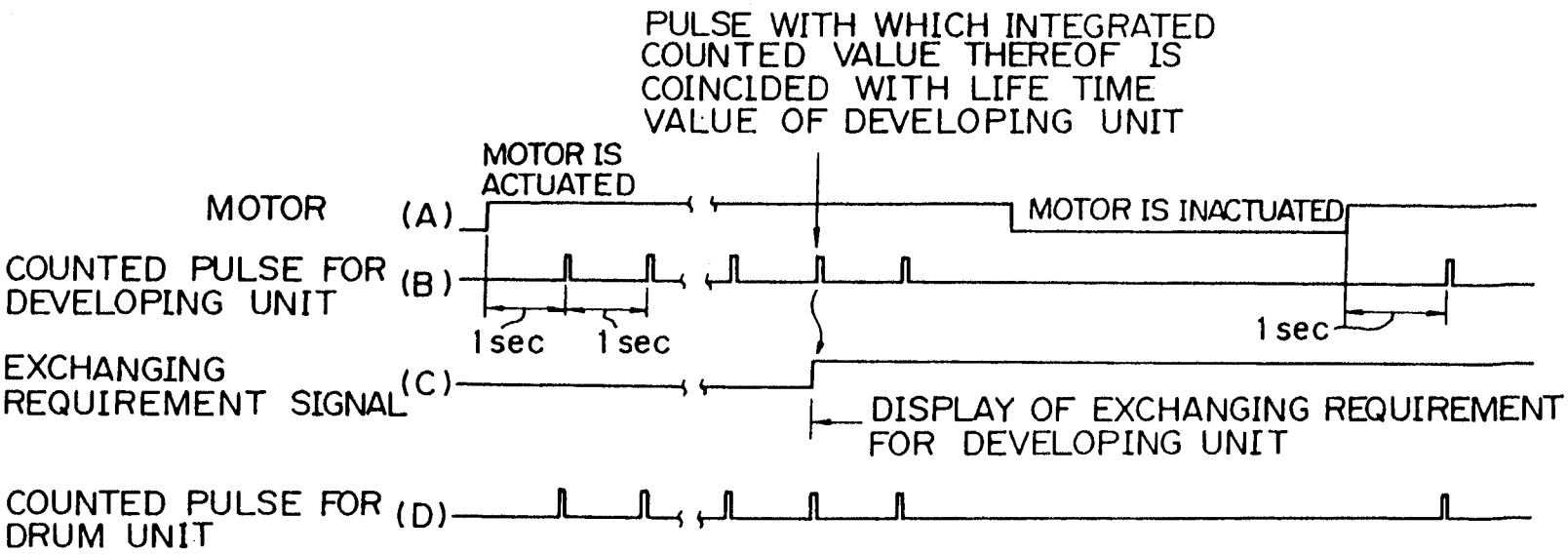
FIG. 6 is a timing chart explaining the operation of one embodiment of the invention.
Figure 7A:
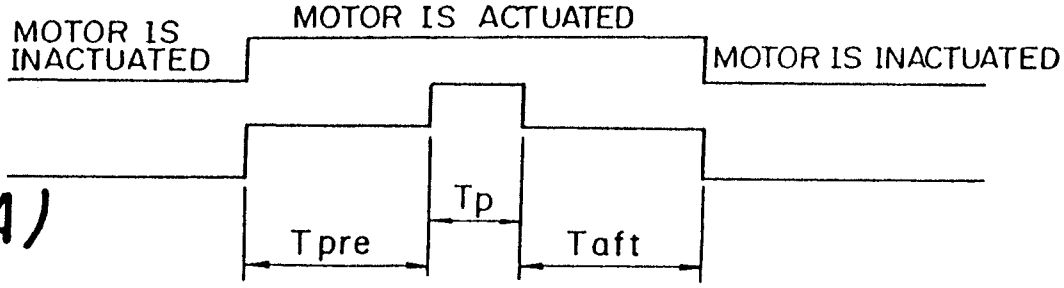
FIGS. 7A and 7B together depict a timing chart explaining the operation of the writing unit used in the present invention.
Figure 7B:
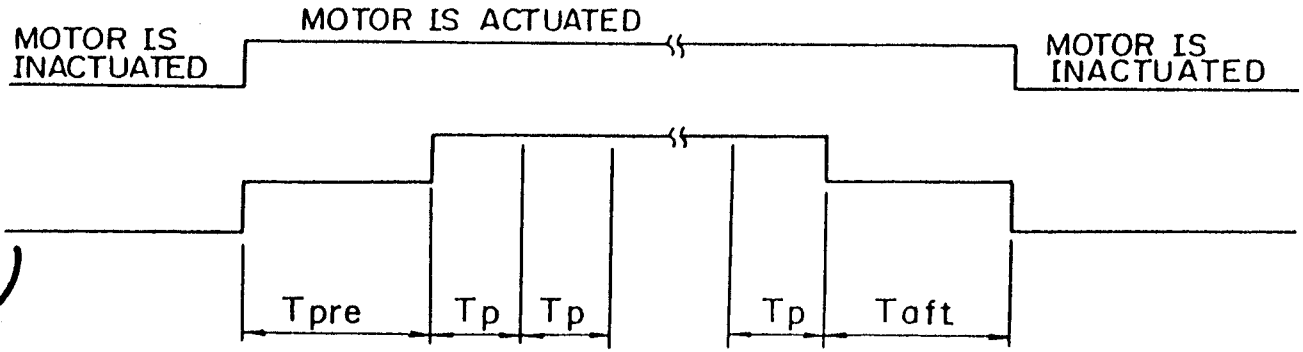

FIG. 5 is a flow chart explaining the operation of one embodiment of this invention, and FIG. 6 is a timing chart explaining the operation of one embodiment of this invention.

When the motor 300 is started, as shown in FIG. 6 (YES at step 500 in FIG. 5), a counted value of each counter 404 of the developing unit 224, the photosensitive drum 214, the fixing unit 242 and the transfer unit 236 is incremented by one at intervals of, for example, one second, in steps 504, 510, 516, and 522 of FIG. 5.

Thereafter, the counted value indicating the integrated working time of each working part is compared with the predetermined lifetime value of the corresponding working part at steps 506, 512, 518, and 524, and when it is confirmed that a counted value of one working part has not reached the respective predetermined lifetime value, the counted value of each working part is stored in the non-volatile memory 406 corresponding to each counter of the working part, at step 532. (This storing operation of step 532 may be carried out after the operation of this device is completed.)

Further, when the counted value of one of the consumable working parts reaches the predetermined lifetime value set for that working part (YES in any one of steps 506, 512, 518, and 524), the exchange requirement signal indicating the need to exchange the working part is generated (at any one of steps 508, 514, 520 and 526) and an indication that the consumable working part must be exchanged, corresponding to the part for which the exchange requirement signal is generated, is displayed at the display means 312 at step 530.

As apparent from FIG. 6, the working time of each working part is checked from the time of starting the image forming device, and the lifetime of each working part is respectively set as a pulse number to introduce the time factor into the lifetime, taking into the account the condition under which the working part concerned is used.

Therefore, the lifetime of each working part is different, and accordingly, even when the exchange requirement signal for the developing unit is generated, the exchange requirement signal for the drum unit is not generated. In this embodiment, in addition to the exchange requirement display system as explained above, a separate display system indicating the need to exchange the working part is provided.

Namely, an exchange requirement signal predicting the possibility of the generation of an exchange requirement signal for a working part after a predetermined number of sheets has been processed, is generated for the working part by a predicting means even when an exchange requirement signal is not generated for that working part, and is displayed together with an exchange requirement signal generated for another working part.

This embodiment is shown in FIG. 5 at step 530.

By utilizing this system, maintenance of the image forming device is simplified, since due to the display of the prediction of an exchange requirement signal, the exchange of a working part having a lifetime which will end within the processing of a predetermined number of cut sheets 200 to be processed, will be made at a correct timing. In this invention, this predetermined number of sheets to be processed may be, for example, 250, and this can be set in accordance with the maximum number of cut sheets contained in a cassette used in this device.

As explained above, when the halogen lamp 310 of the fixing unit is turned ON while the motor of this device is not energized, preferably the pulse count by the counter of the working part while the lamp 310 is turned ON before the motor is energized, is given a suitable weighting.

This concept can be applied to other count operations in this device, and therefore, in, for example, the writing unit, the count may be carried out by applying different weightings to the counted pulse numbers in the preliminary processing period and in the actual writing period, respectively. This coefficient of this weighting can be determined in accordance with the construction of the device, by previous experiments.

Hereafter, another control system will be explained with reference to FIGS. 8, 9, and 10, in which the display for exchanging a working part is carried out by a process comprising the steps of: supplying power to the device to generate a pulse from a pulse generator; counting this pulse by the integrating working time means for a working part to determine the integrated working time of the part; storing the counted number of pulses to the memory means for the part; comparing the counted number of pulses with a predetermined number corresponding to the lifetime of the working part stored in the lifetime setting means; generating an exchange requirement signal for the working part when the counted number of pulses reaches the predetermined set number; storing the exchange requirement signal in a memory; previously determining the possibility of a generation of an exchange requirement signal after a predetermined number of sheets have been processed, and thereafter, when the counted number of pulses has not reached the predetermined set number, generating a predicted exchange requirement signal for a working part when it is predicted that the exchange requirement signal will be generated after a predetermined number of sheets have been processed, and storing the predicted exchange requirement signal in a memory; repeating the above steps for each of several other working parts, successively one by one; and displaying the exchange requirement signal at the display means when the counted numbers of pulses of one of the working parts reaches the predetermined set number, and simultaneously, displaying the predicted exchange requirement signal for one of working parts shows for which the exchange requirement signal will be generated after a predetermined number of sheet have been processed.

Figure 8:
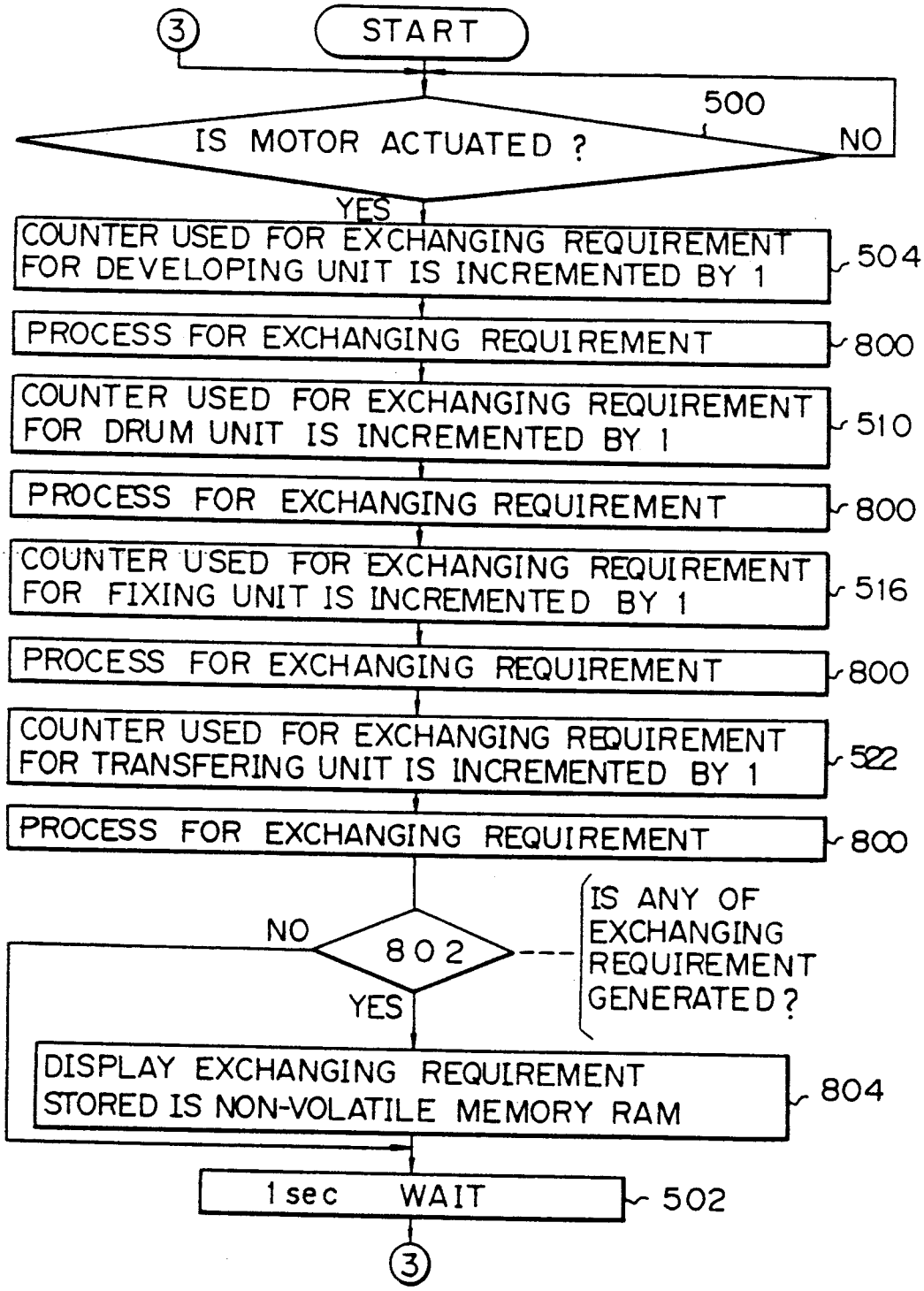
FIGS. 8, 9 and 10 are flow charts explaining the operations of other embodiments of the present invention.
Figure 9:
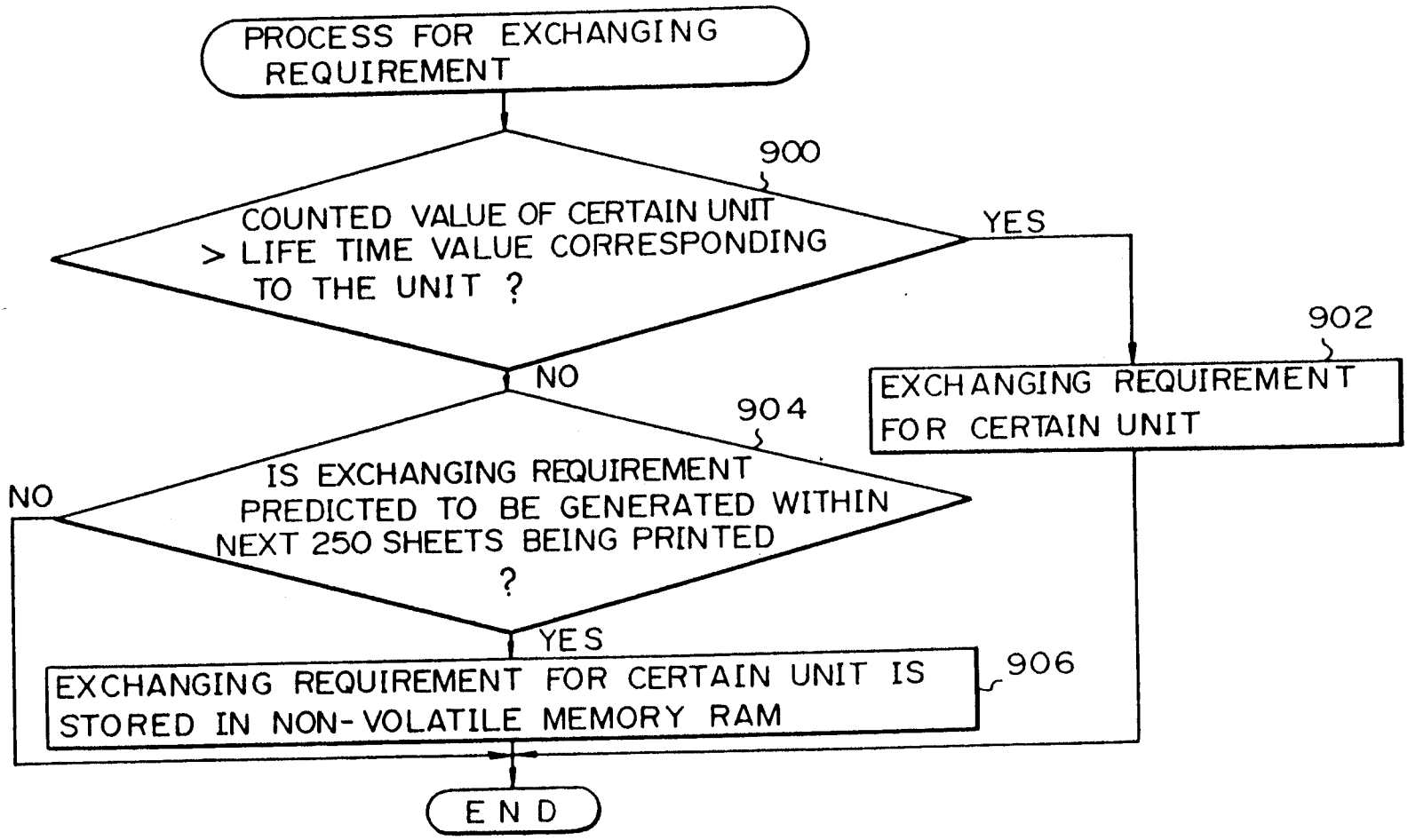
Figure 10:
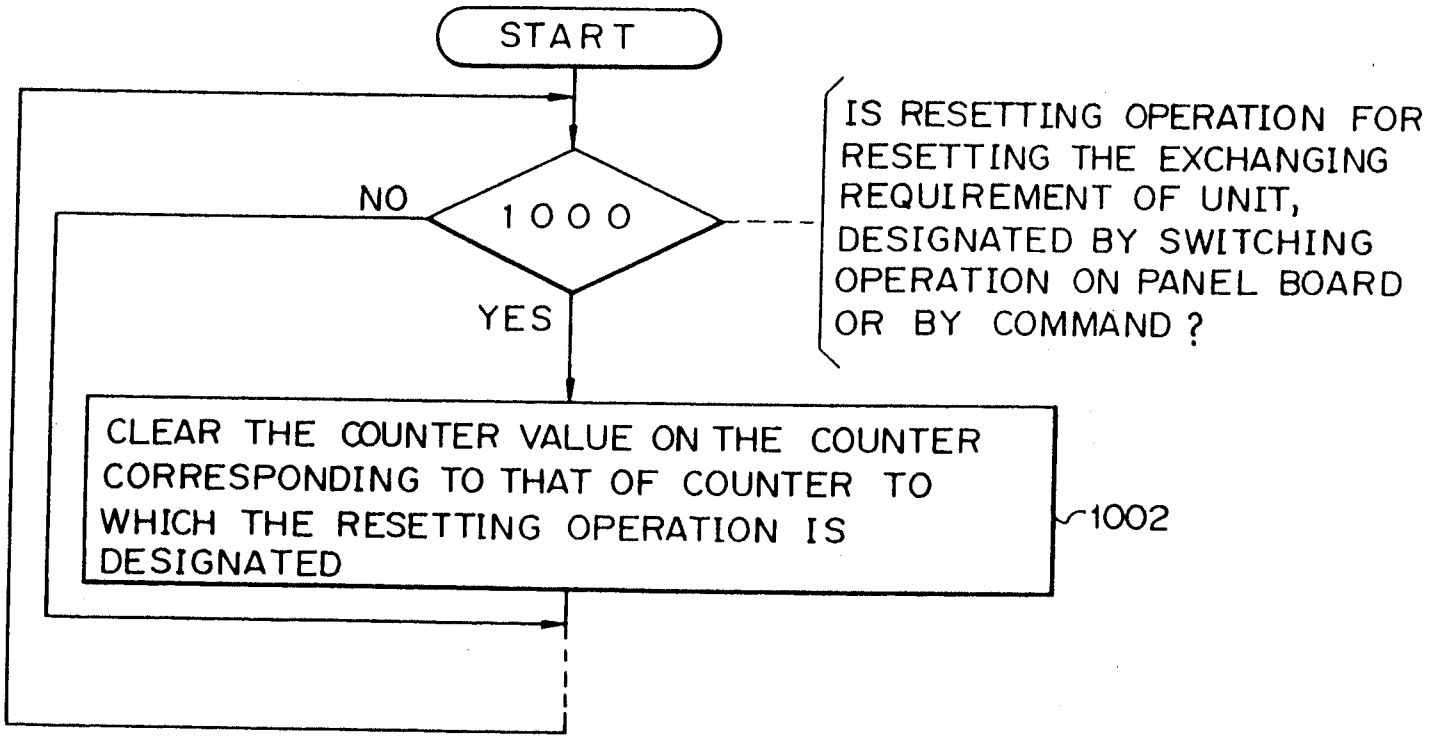

The specific embodiment of this process is explained in FIGS. 8 to 10. In this embodiment, when the motor 300 is started (YES at step 500 in FIG. 8), a counted value of each counter 404 for the developing unit 224, the photosensitive drum 214, the fixing unit 242 and the transfer unit 236 is incremented by one at internals of, for example one second, at steps 504, 510, 516, and 522 in FIG. 5, and each time the counters are incremented, the process for an exchange requirement for each working part as shown in the flow chart in FIG. 9 is carried out at step 800.

In this flow chart, the current counted value just incremented is compared with the lifetime value corresponding to the working part, at step 900, and when the counted value is higher than the lifetime value set (YES at step 900), the exchange requirement signal for that working part is generated at step 902.

When the counted value is lower than the lifetime value set (NO at step 900), then it is determined whether or not the exchange requirement of a working part will be generated before a predetermined number of sheets, for example, 250 sheets, is printed, at step 904, and when the occurrence of an exchange requirement is predicted (YES at step 904), this predicted exchange requirement signal is stored in the non-volatile memory 406 at step 906.

After the incrementing of the counter and the process for the exchange requirement are completed for all of the working parts in this device, it is determined whether or not the exchange requirement signal for a working part at which the counted value is more than the lifetime of the working part is generated, at step 802.

At that time, when the generation of the exchange requirement signal for a working part is predicted (YES at step 802) the predicted exchange ..requirement signal for that working part stored in the non-volatile memory 406 is read out, and all of the exchange requirement signals are displayed at the display means at step 804.

In this embodiment, the predicted exchange requirement signal may be generated, for example, in such a way that a difference value obtained by subtracting the integrated pulse number counted from the lifetime value previously set is compared with an average time required when a predetermined number of cut sheets, for example, 250 sheets, is to be processed, and when the difference value is less than the average time, the predicted exchange requirement signal is generated.

The process in the flow chart of FIG. 10 may be carried out simultaneously with the process of FIG. 8. Namely, after the working part to be exchanged has been exchanged in accordance with the display, and when the reset signal for resetting the exchange requirement for the working part is generated by a switching operation on the switching panel, or when the reset signal for resetting the exchange requirement for the working part is automatically generated by an automatic detection of the exchange operation of the working part (YES at step 1000), the value of the counter to be reset is cleared at step 1002. As explained above, in accordance with this invention, the indication of the exchange requirement signal for a working part is displayed when the integrated working time of each of the consumable working parts reaches a predetermined time set therefor, whereby the exchange of the consumable working part can be carried out easily and at correct intervals.

Therefore, an unnecessary exchange of the consumable working parts is effectively avoided, and further, a deterioration of the quality of the printed matter caused by an over usage of a working part, can be avoided.

As explained above, in accordance with this invention, the exchange of each consumable working part can be carried out within a suitable period, whereby a waste of such consumable working parts can be avoided and the quality of the printed characters can be maintained at a high level.

We claim:

1. An image forming apparatus for forming an image on a medium wherein said apparatus comprises;

a driving source;

a plurality of processing devices for forming an image on said medium and being consumable and exchangeable individually, and said processing devices including at least a drum unit, a developing unit, and a fixing unit;

a means for transmitting the driving force of said driving source to each said processing devices so as to rotate said drum unit, said developing unit, and said fixing unit in accordance with driving motion of said driving source;

means for integrating a working time of each of the processing devices respectively in accordance with a driving time of said driving source to obtain an integrated working time of each processing device respectively;

a memory means for storing said integrated working time of each processing device respectively therein;

a life time setting means in which a predetermined life time of each processing device is set out respectively; and a means for generating an exchanging requirement signal for said processing device when said integrated working time thereof reaches said life time of said processing device, set out in said life time setting means.

2. An image forming apparatus according to claim 1, wherein said apparatus further comprises a display means for displaying at least one of said exchanging requirement signal of each processing device.

3. An image forming apparatus according to claim 1, wherein a display means for exchanging a processing device carries out a process comprising the steps of;

supplying power to said apparatus to generate a pulse from a pulse generator, counting this pulse by said integrating working time means for a processing device to determine said integrated working time of said processing device, storing said counted number of pulses to said memory means for said processing device, comparing said counted number of pulses with said predetermined lifetime of said processing device and stored in said lifetime setting means generating said exchange requirement signal for said processing device when said counted number of pulses reaches said predetermined set number, storing said exchange requirement signal in a memory, repeating said steps for each of several other processing devices, successively one by one, displaying at least one of said exchange requirement signals at said display means when the counted numbers of pulses of at least one of said processing devices has reached said predetermined set number, utilizing said exchange requirement signal stored in said memory above for said processing device.

4. An image forming apparatus according to claim 3, wherein said display step is further characterized in that at least one of the predicted exchange requirement signals for predicting said possibility of said generation of said exchange requirement signal, to exchange a processing device after a predetermined number of sheets has been processed, generated by a predicting means when said exchange requirement signal is not generated for a processing device, is displayed together with said exchange requirement signal generated for another of said processing devices.

5. An image forming apparatus according to claim 1, wherein a display means for an exchange of processing device carries out a process comprising the steps of;

supplying power to said apparatus to generate a pulse from a pulse generator, counting this pulse by said integrating working time means for a processing device to determine said integrated working time of said processing device, storing said counted number of pulses to said memory means for said processing device, comparing said counted number of pulses with said predetermined lifetime of said processing device and stored in said lifetime setting means, generating said exchange requirement signal for said processing device when said counted number of pulses reaches said predetermined set number, storing said exchange requirement signal in a memory, predicting a possibility of said generation of said exchange requirement signal for an exchange of said processing device after a predetermined number of sheets have been processed when said counted number of pulses does not reach said predetermined set number, generating a predicted exchange requirement signal for a processing device when it is predicted that an exchange requirement signal will be generated after a predetermined number of sheets have been processed, and storing said predicted exchange requirement signal in a memory, repeating the above steps for each of several other processing devices, successively one by one, and displaying said exchange requirement signal at said display means when the counted number of pulses of one of said processing devices reaches said predetermined set number and simultaneously, displaying said predicted exchange requirement signal when at least one of said processing devices for which said exchange requirement signal is not generated is predicted to need exchanging after a predetermined number of sheets has been processed.

6. An image forming apparatus according to claim 1, wherein said apparatus further comprises a control means for controlling the driving source and processing devices so as to operate an initializing by the processing device.

7. An image forming apparatus according to claim 1, wherein said apparatus further comprises a predicting means for predicting a possibility of a generation of said exchange requirement signal for at least one of said processing devices to be exchanged after a predetermined number of sheets has been processed in cooperation with said exchange requirement signal generating means, when said exchange requirement signal generating means does not generate said exchange requirement signal for said processing devices, and a memory and display means for storing and displaying a predicted exchange requirement signal generated by said predicting means.

8. An image forming apparatus according to claim 7, wherein data is counted as said integrated working time of each processing device, said exchange requirement signals for respective processing devices and said predicted exchange requirement signals for respective processing devices are stored in a non-volatile memory.

9. An image forming apparatus according to claim 1 or 7, wherein said apparatus is characterized in that said means for integrating said working time of each of said processing devices comprises a counting means for counting said integrated working time of each processing device respectively with a weighting factor depending upon conditions under which said processing devices are operated.

10. An image forming apparatus according to claim 1 or 3, wherein a counting operation for counting said integrated working time by said means for integrating is carried out by counting a clock pulse generated by a clock pulse generator, starting when an electric power is applied to drive said apparatus and stopping when said electric power is not applied to said apparatus.

* * * * *